US009565959B1

(12) United States Patent
She

(10) Patent No.: US 9,565,959 B1
(45) Date of Patent: Feb. 14, 2017

(54) TEA TRAY ASSEMBLY

(71) Applicant: Zacabo Industry Co., Ltd., Taoyuan (TW)

(72) Inventor: Chang-Chia She, Taoyuan (TW)

(73) Assignee: Zacabo Industry Co., Ltd., Taoyuan (TW)

( * ) Notice: Subject to any disclaimer, the term of this patent is extended or adjusted under 35 U.S.C. 154(b) by 0 days.

(21) Appl. No.: 15/156,453

(22) Filed: May 17, 2016

(51) Int. Cl.

| | |
|---|---|
| ***A47G 29/00*** | (2006.01) |
| ***A47G 23/03*** | (2006.01) |
| ***A47G 23/06*** | (2006.01) |
| ***A47J 47/16*** | (2006.01) |

(52) U.S. Cl.
CPC ..... *A47G 23/03* (2013.01); *A47G 23/06* (2013.01); *A47G 23/0633* (2013.01); *A47J 47/16* (2013.01)

(58) Field of Classification Search
USPC ..... 248/346.11
See application file for complete search history.

(56) References Cited

U.S. PATENT DOCUMENTS

| | | | | | |
|---|---|---|---|---|---|
| 2,727,645 | A * | 12/1955 | Dore | A47G 23/03 | 215/393 |
| 3,268,198 | A * | 8/1966 | Swett | A47G 19/2283 | 248/346.11 |
| 5,839,598 | A * | 11/1998 | Mitchell | B65D 1/16 | 220/212 |
| 6,089,519 | A * | 7/2000 | Laybourne | A47G 23/03 | 220/212 |
| 6,405,638 | B1 * | 6/2002 | Chen | A47G 19/14 | 99/317 |
| 8,240,631 | B2 * | 8/2012 | Schrock | B60N 3/101 | 215/393 |
| 8,839,983 | B2 * | 9/2014 | Chiou | B65D 25/24 | 220/626 |
| 9,414,708 | B2 * | 8/2016 | Liu | A47J 31/0605 | |
| 2002/0134903 | A1 * | 9/2002 | Lin | A47G 19/2261 | 248/346.11 |
| 2004/0187859 | A1 * | 9/2004 | Tseng | A47J 36/245 | 126/246 |
| 2009/0020018 | A1 * | 1/2009 | Melzer | A47J 31/0615 | 99/288 |
| 2014/0123856 | A1 * | 5/2014 | Liu | A47J 31/061 | 99/279 |
| 2015/0366395 | A1 * | 12/2015 | Do | A47J 31/0626 | 99/323 |
| 2016/0113433 | A1 * | 4/2016 | Hsu | A47J 31/0615 | 99/283 |

* cited by examiner

*Primary Examiner* — Monica Millner
(74) *Attorney, Agent, or Firm* — Alan D. Kamrath; Kamrath IP Lawfirm, P.A.

(57) ABSTRACT

A tea tray assembly includes a disc having a positioning groove in a top face thereof. A positioning hole extends from a bottom wall of the positioning groove through a bottom face of the disc. A water discharge box is mounted to the bottom face of the disc and includes a body having a water discharge chamber. The body further includes an abutment portion extending transversely from an upper edge thereof and abutting the bottom face of the disc. A tightening member includes a connecting portion extending through the positioning hole of the disc. A pressing and holding portion of the connecting portion is located in the positioning groove of the disc. An outer thread of the connecting portion securely engages with an inner thread of the water discharge box, retaining the pressing and holding portion to the bottom wall of the positioning groove.

9 Claims, 9 Drawing Sheets

TEA TRAY ASSEMBLY

BACKGROUND OF THE INVENTION

The present invention relates to a tea tray assembly and, more particularly, to a tea tray assembly permitting easy manufacture and assembly, discharging water and fragments of tea leaves, permitting ease of use, and avoiding accumulation of water and untidiness.

A tea tray can support a teapot, tea cups, and other tea making tools and can be made of various materials, such as metal, wood, bamboo, and a ceramic material. Tea trays generally include a single layer or a dual layer structure. In a single layer structure, a water outlet coupler having a water outlet is disposed on a side of a tea tray, and a drainage tube is coupled to an outer periphery of the water outlet coupler, such that waste tea/water and fragments of tea leaves on the tea tray can be discharged via the water outlet and the drainage tube.

However, in the single layer structure, the diameter of the water outlet is smaller than an inner diameter of the drainage tube, such that a resistance could occur due to existence of air in the drainage tube while draining water. The water drainage is not smooth, the flow of water is slow, and water is apt to accumulate on the tea tray. Furthermore, the fragments of tea leaves in the water flow are pat to get stuck in the water outlet and must be cleaned and removed manually.

In a tea tray having a double layer structure, a drainage hole is defined in an upper supporting disc, and a lower supporting disc is used to receive waste tea/water. When it is desired to clean the lower supporting disc, the upper supporting disc must be removed, which is relatively inconvenient. Furthermore, the lower supporting disc has a relatively large area, which is troublesome to the user cleaning the tea tray.

Thus, a need exists for a novel tea tray that mitigates and/or obviates the above disadvantages.

BRIEF SUMMARY OF THE INVENTION

The primary objective of the present invention is to position a water discharge box to a positioning hole of a disc by a tightening member to achieve an effective water discharge function for permitting easy assembly and disassembly of the tea tray, meeting the practical needs.

The secondary objective of the present invention is to provide a water outlet including a first passage having an inner diameter not smaller than an inner diameter of the drainage tube, such that waste tea/water from a water discharge chamber can rapidly fill the first passage and the drainage tube to reduce the water flow resistance, rapidly and smoothly discharging the waste tea/water and fragments of tea leaves and avoiding accumulation of water resulting from slow discharge of water in the tea tray. Thus, blockage at the water outlet of the tea tray can be avoided to save manual cleaning and dredging.

To achieve the above objectives, a tea tray assembly according to the present invention includes a disc having a top face and a bottom face opposite to the top face. A positioning groove is defined in the top face and has a bottom wall located between the top face and the bottom face of the disc. A positioning hole extends from the bottom wall of the positioning groove through the bottom face of the disc. A water discharge box is mounted to the bottom face of the disc. The water discharge box includes a body having a water discharge chamber with an upwardly facing opening.

The water discharge chamber delimited by an inner peripheral wall has an inner thread. The body further includes an abutment portion extending transversely from an upper edge thereof. A surface of the abutment portion abuts the bottom face of the disc. A tightening member includes a connecting portion. The connecting portion is hollow and has an outer thread. The connecting portion further includes a pressing and holding portion. The connecting portion extends through the positioning hole of the disc. The pressing and holding portion is located in the positioning groove of the disc. The outer thread of the connecting portion securely engages with the inner thread of the water discharge box, retaining the pressing and holding portion to the bottom wall of the positioning groove.

In an example, a limiting space is defined in a face of the abutment portion of the water discharge box, and a gasket is mounted in the limiting space. The gasket is securely sandwiched between the abutment portion and the bottom face of the disc.

In an example, the body of the water discharge box includes a side having a water outlet, and the water discharge chamber of the body includes a bottom wall having a guiding channel intercommunicated with the water outlet.

The tea tray assembly can further include a filtration plate mounted in the connecting portion of the tightening member.

The tea tray assembly can further include a base mounted below the disc. The base includes a receiving space therein and an upper face. A positioning rib is formed on the bottom face of the disc and is annular. The bottom face of the disc abuts the upper face of the base. The positioning rib is positioned at an inner periphery delimiting the receiving space.

In an example, the body of the water discharge box includes a side having a water outlet. A connecting tube and a drainage tube are coupled to the water outlet. The connecting tube includes a first end having a first passage defined therein and a second end having a second passage defined therein and intercommunicated with the first passage. The second passage has an inner diameter larger than an inner diameter of the first passage. The first passage intercommunicates with the water discharge chamber. An end of the drainage tube is inserted into the second passage of the connecting tube. The inner diameter of the first passage is not smaller than an inner diameter of the drainage tube.

In an example, the water outlet of the water discharge box has an inner thread, and the connecting tube has an outer thread in threading connection with the inner thread of the water outlet.

In an example, the connecting tube includes a stop face formed at an intersection between the second passage and the first passage, and an end of the drainage tube abuts and is positioned at the stop face.

The tea tray assembly can further include a tightening sleeve mounted to an outer periphery of the connecting tube and an outer periphery of the drainage tube. The tightening sleeve includes a first tightening portion on an end thereof and a second tightening portion on the other end thereof. The connecting tube includes an outer periphery having a tight-fitting conical face. The first tightening portion is mounted around the tight-fitting conical face. The second tightening portion is mounted around the drainage tube.

The present invention will become clearer in light of the following detailed description of illustrative embodiments of this invention described in connection with the drawings.

DETAILED DESCRIPTION OF THE INVENTION

Figure 1:
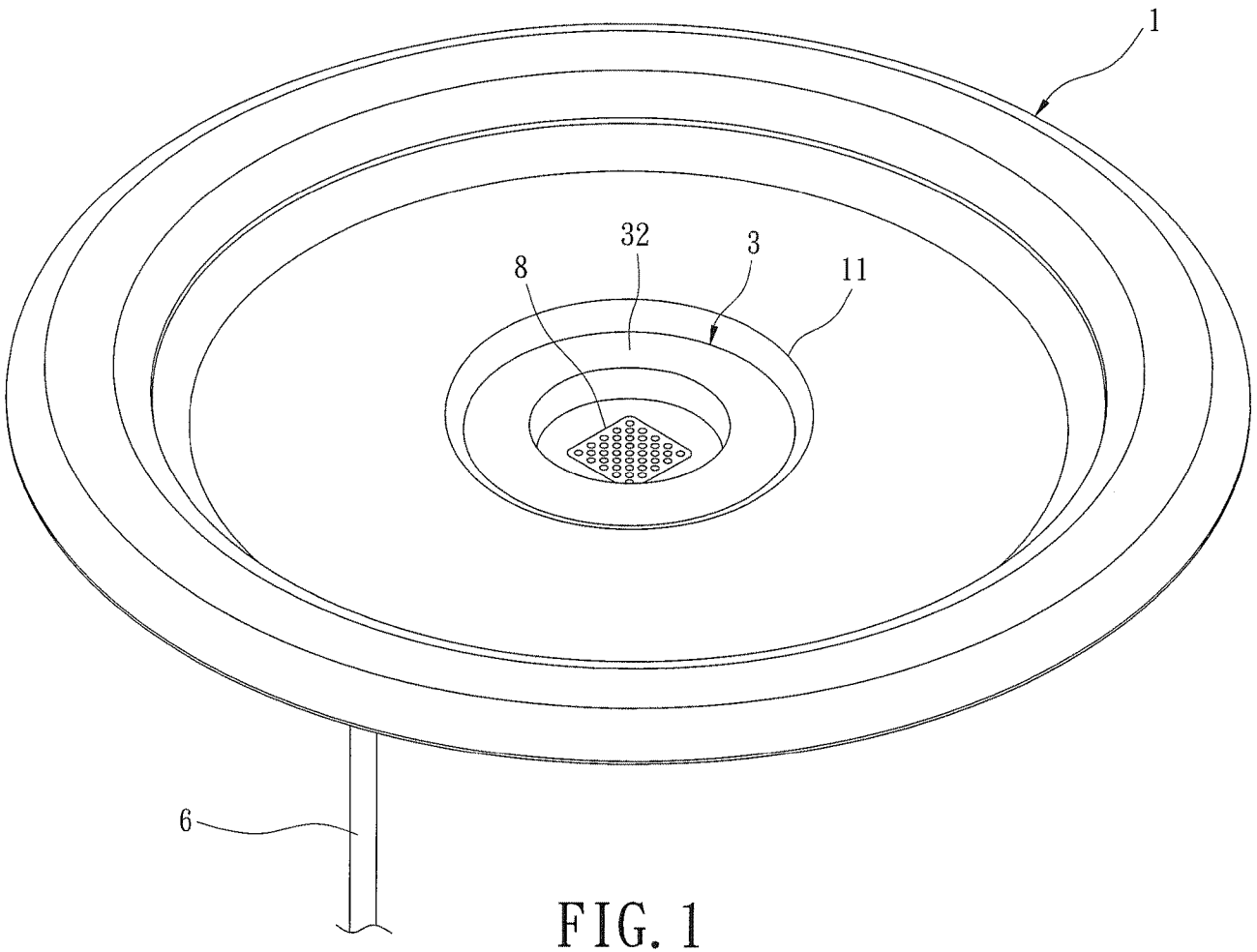
FIG. 1 is a perspective view of a tea tray assembly according to the present invention.

With reference to FIGS. 1-7, a tea water assembly of an embodiment according to the present invention includes a disc 1, a base 14, a water discharge box 2, a tightening member 3, a gasket 4, a connecting tube 5, a drainage tube 6, a tightening sleeve 7, and a filtration plate 8.

The disc 1 includes a top face and a bottom face opposite to the top face. A positioning groove 11 is defined in the top face and has a bottom wall located between the top face and the bottom face of the disc 1. A positioning hole 12 extends from the bottom wall of the positioning groove 11 through the bottom face of the disc 1. A positioning rib 13 is formed on the bottom face of the disc 1 and is annular. A base 14 is mounted below the disc 1 and includes a receiving space 15 therein and an upper face. A through-hole 16 is defined in a side of base 14 and intercommunicates with the receiving space 15.

The water discharge box 2 is mounted to the bottom face of the disc 1. The water discharge box 2 includes a body 21 having a water discharge chamber 211 with an upwardly facing opening. The water discharge chamber 211 is delimited by an inner peripheral wall having an inner thread 212. The body 21 further includes an abutment portion 22 extending transversely from an upper edge thereof. A limiting space 221 is defined in a face of the abutment portion 22 of the water discharge box 2. The body 21 of the water discharge box 2 includes a side having a water outlet 23 with an inner thread 231. The water discharge chamber 211 of the body 21 includes a bottom wall having a guiding channel 213 intercommunicated with the water outlet 23.

The tightening member 3 includes a connecting portion 31. The connecting portion 31 is hollow and has an outer thread 311. The connecting portion 311 further includes a pressing and holding portion 32 extending transversely from an upper edge thereof. Furthermore, reinforcing ribs 33 are disposed in the connecting portion 311. In this embodiment, an end of each reinforcing rib 33 is connected to an inner periphery of the connecting portion 311.

The connecting tube 5 includes a first end having an outer thread 51. The connecting tube 5 further includes a second end having a tight-fitting conical face 52 on an outer periphery thereof. The connecting tube 5 includes a first passage 53 in the first thereof and a second passage 54 in second end thereof and intercommunicated with the first passage 53. The second passage 54 has an inner diameter larger than an inner diameter of the first passage 53. The connecting tube 5 includes a stop face 55 formed at an intersection between the second passage 54 and the first passage 55. The inner diameter of the first passage 53 is not smaller than an inner diameter of the drainage tube 6.

The tightening member 7 is made of an elastic material. The tightening sleeve 7 includes a first tightening portion 71 on an end thereof and a second tightening portion 72 on the other end thereof. The tightening sleeve 7 is mounted to an outer periphery of the connecting tube 5 and an outer periphery of the drainage tube 6. The filtration plate 8 is mounted to the reinforcing ribs 33 fixed to the inner periphery of the connecting portion 31 of the tightening member 3.

Figure 4:
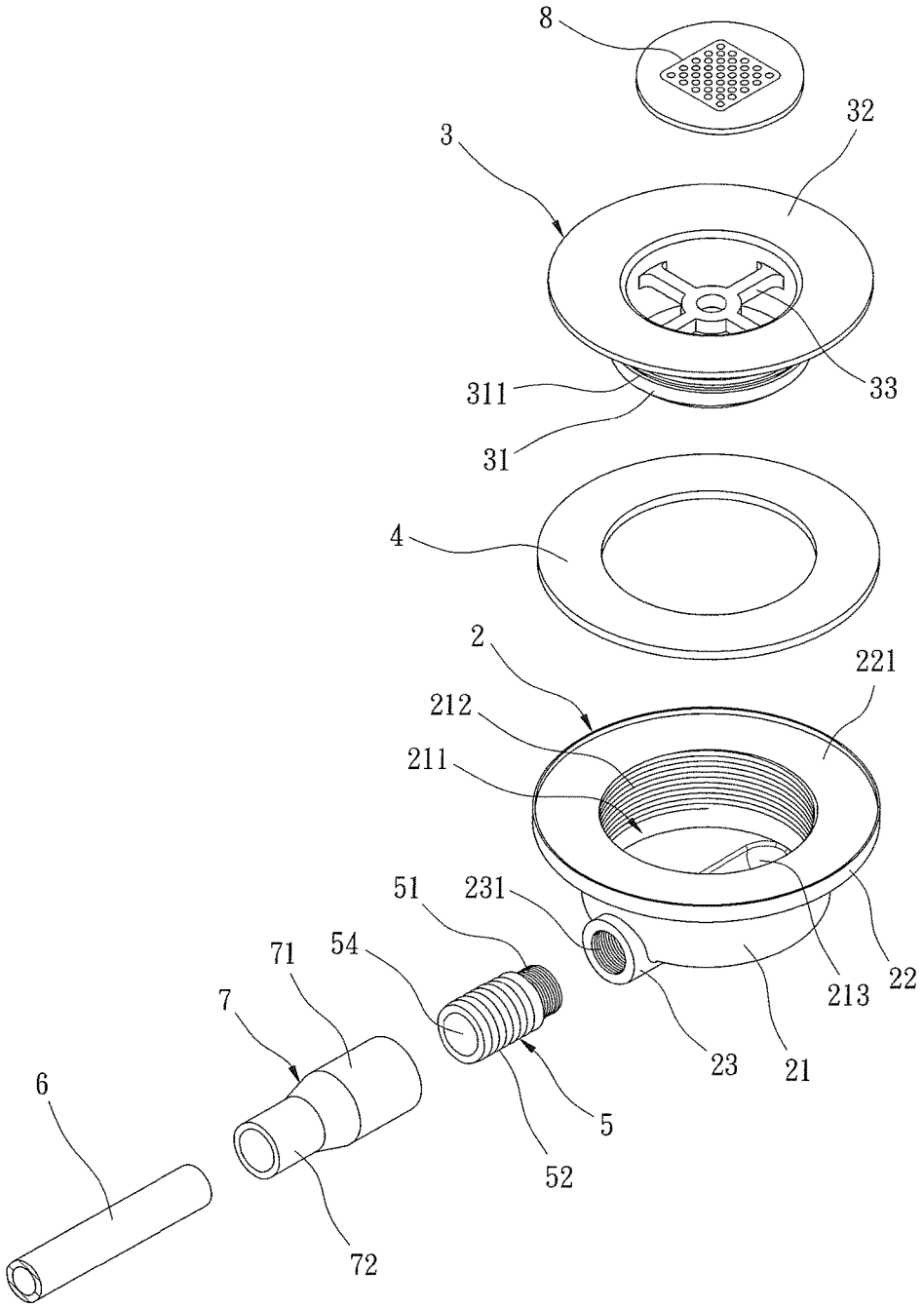
FIG. 4 is an exploded, perspective view of other components of the tea tray assembly of FIG. 1.
Figure 5:
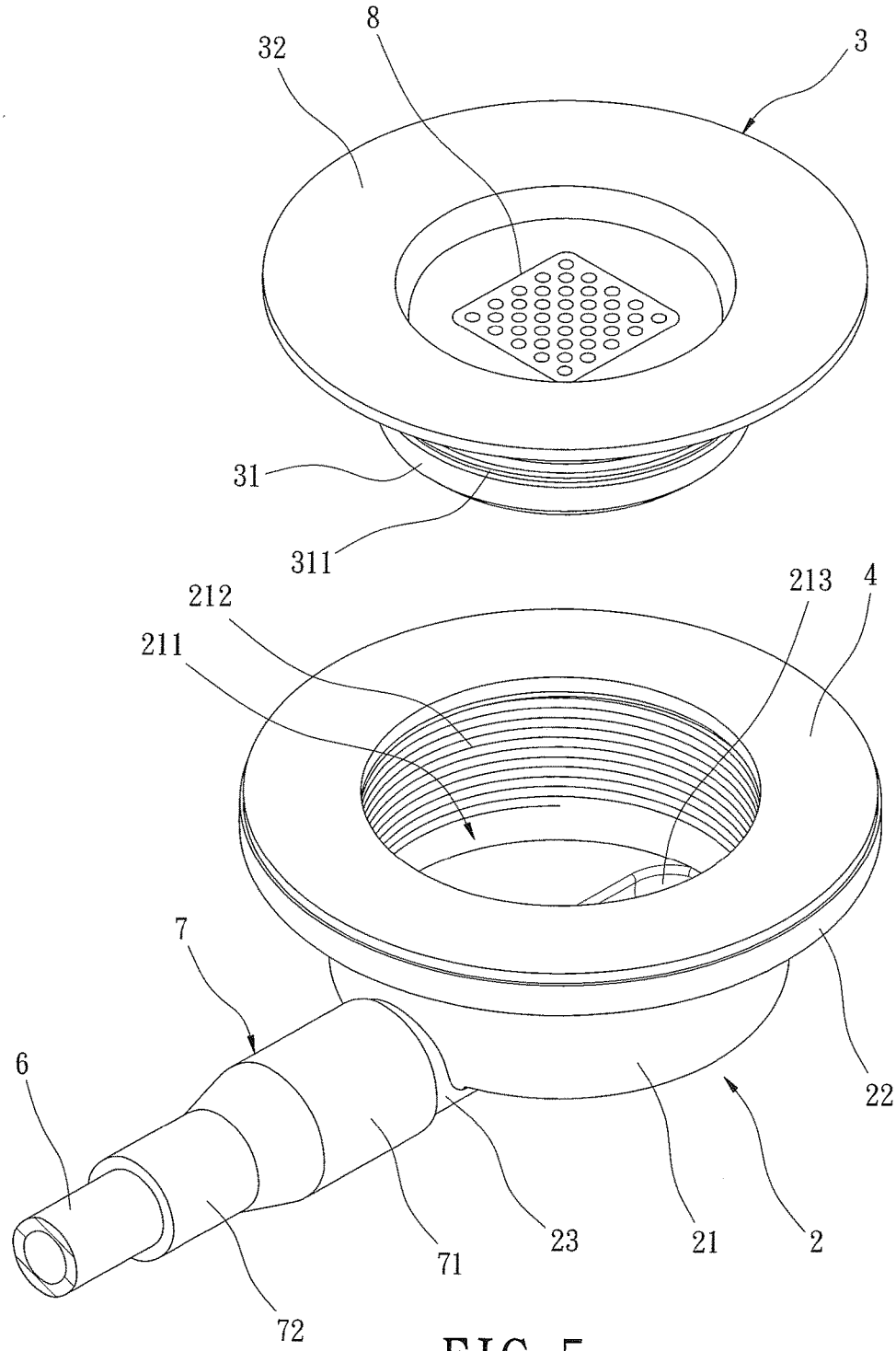
FIG. 5 is a partially exploded perspective view of the components of FIG. 4.
Figure 6:
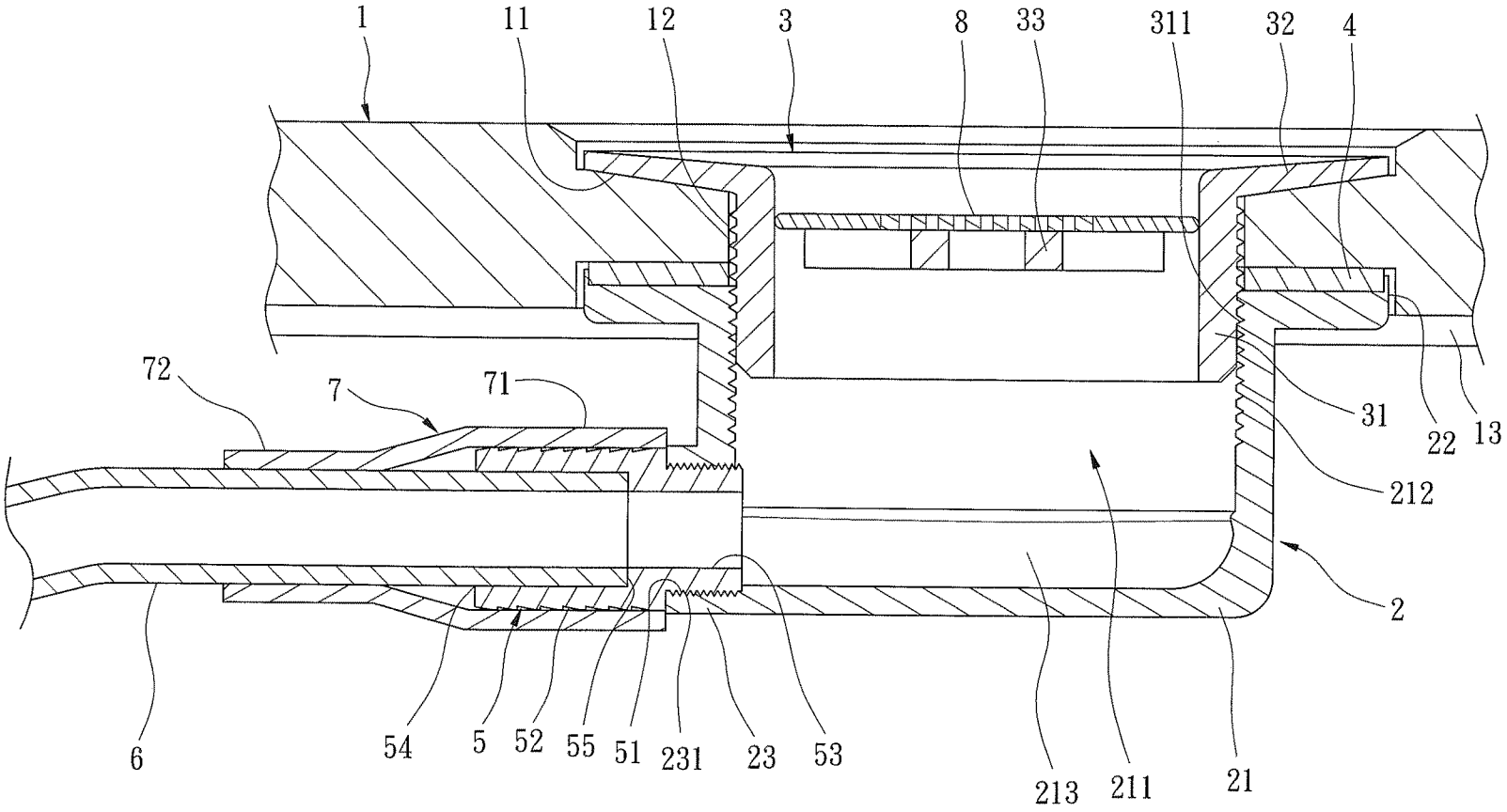
FIG. 6 is a partial, enlarged, cross sectional view of the tea tray assembly of FIG. 1.

With reference to FIGS. 4-6, in assembly, the gasket 4 is mounted in the limiting space 221 of the water discharge box 2. The water discharge box 2 is disposed on the bottom face of the disc 1, and a surface of the abutment portion 22 abuts the bottom face of the bottom face of the disc 1. Next, the connecting portion 311 of the tightening portion 3 extends through the positioning hole 12 of the disc 1. The pressing and holding portion 32 is located in the positioning groove 11 of the disc 1. The outer thread 311 of the connecting portion 31 securely engages with the inner thread 212 of the water discharge box 2, retaining the pressing and holding portion 32 to the bottom wall of the positioning groove 11. The gasket 4 is securely sandwiched between the abutment portion 22 and the bottom face of the disc 1. The filtration plate 8 is mounted to the reinforcing ribs 33 fixed to the inner periphery of the connecting portion 31 of the tightening member 3. Thus, the water discharge box 2 and the tightening member 3 are positioned to the positioning hole 12 of the disc 1.

Figure 7:
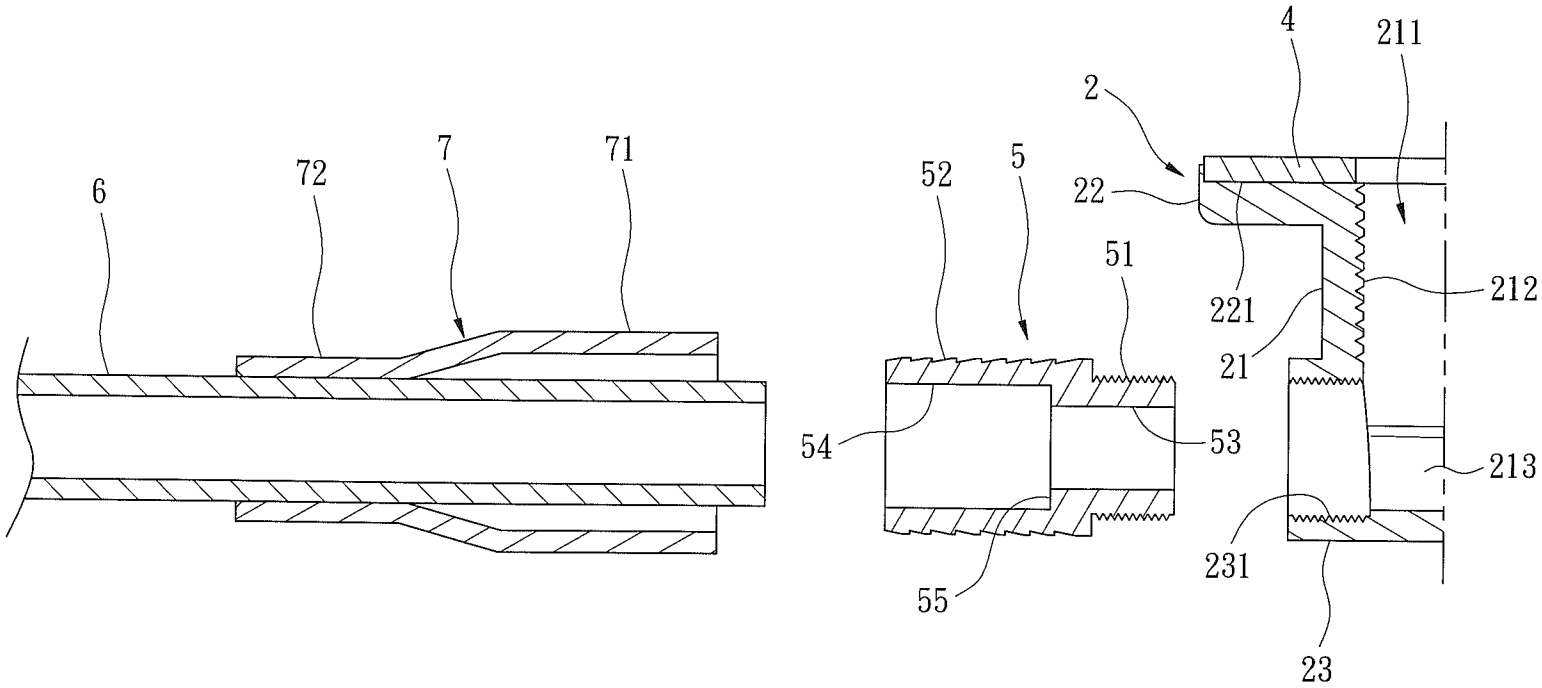
FIG. 7 is an exploded, cross sectional view illustrating assemblage of a drainage tube, a connecting tube, and the water discharge box.

With reference to FIGS. 6 and 7, in assembly of the connecting tube 5, the drainage tube 6, and the tightening sleeve 7, the outer thread 51 is threadedly engaged with the inner thread 231 of the water outlet 23 to intercommunicate the first passage 53 with the water discharge chamber 211 of the body 21. The drainage tube 6 is inserted into the second passage 54 of the connecting tube 5 via the second tightening portion 72 of the tightening sleeve 7 and is stopped by the stop face 55, providing a positioning effect. Then, the first tightening portion 71 is securely mounted around the tight-fitting conical face 52, and the second tightening portion 72 is located mounted around the drainage tube 6.

Figure 2:
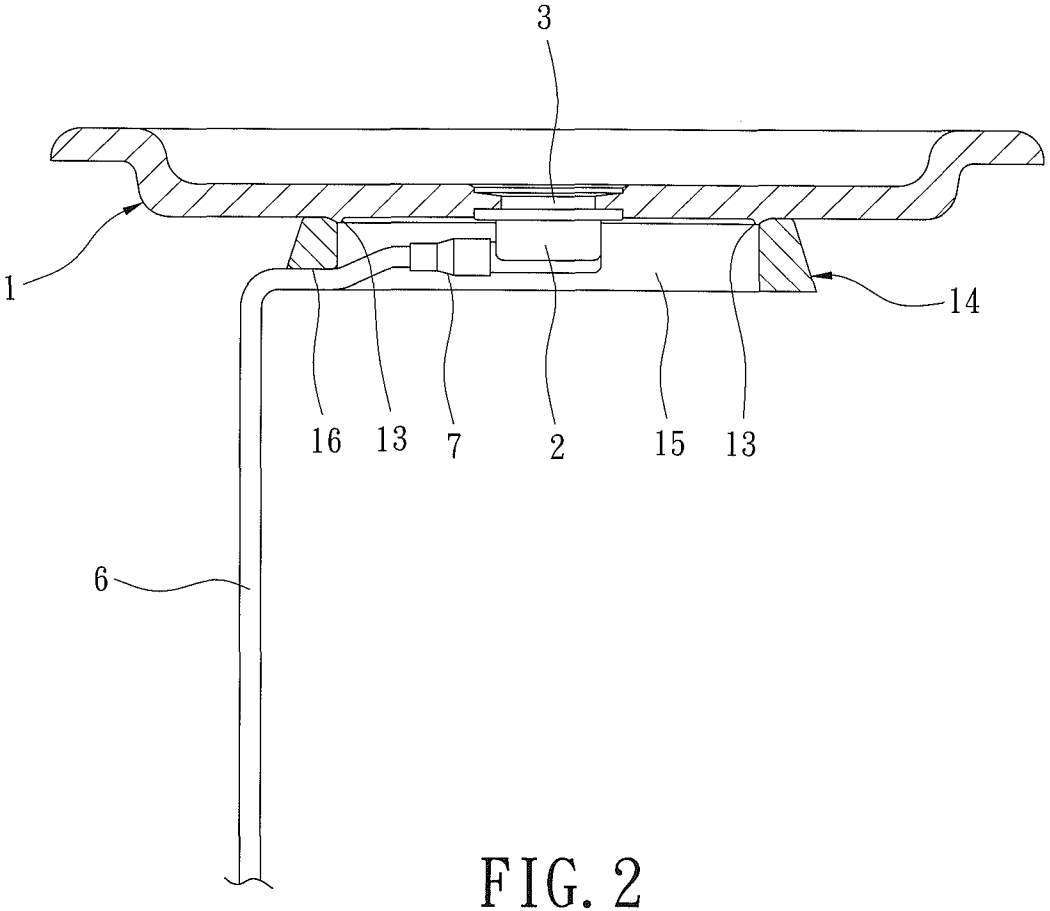
FIG. 2 is a cross sectional view of the tea tray assembly of FIG. 1.
Figure 3:
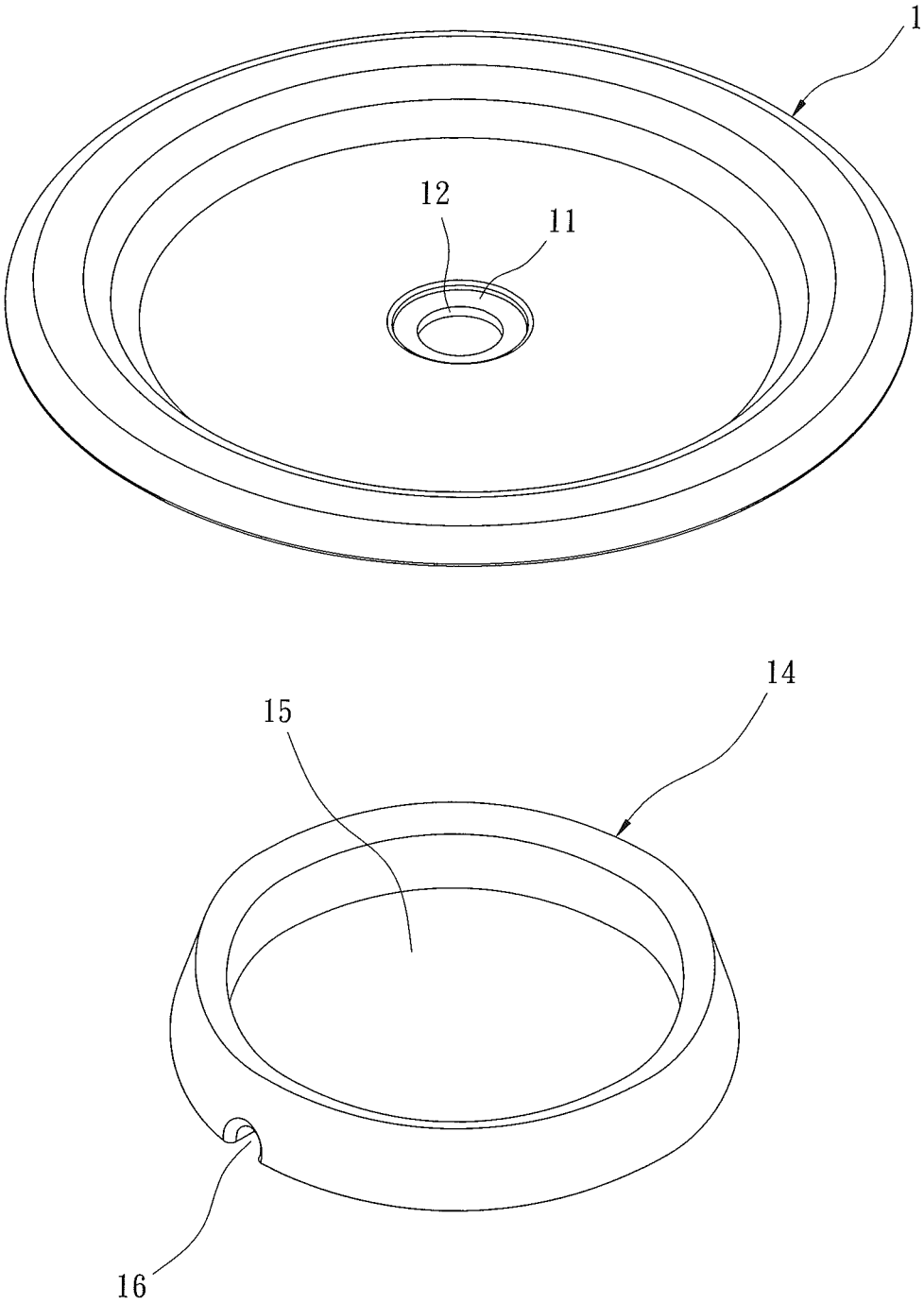
FIG. 3 is an exploded, perspective view showing a disc and a base of the tea tray assembly of FIG. 1.

With reference to FIGS. 2 and 3, the base 14 is disposed below the disc 1. The bottom face of the disc 1 abuts the upper face of the base 14. The positioning rib 13 is positioned at an inner periphery delimiting the receiving space 15. The drainage tube 6 extends through the through-hole 16 of the base 14. Assemblage of the tea tray assembly is, thus, completed.

Figure 8:
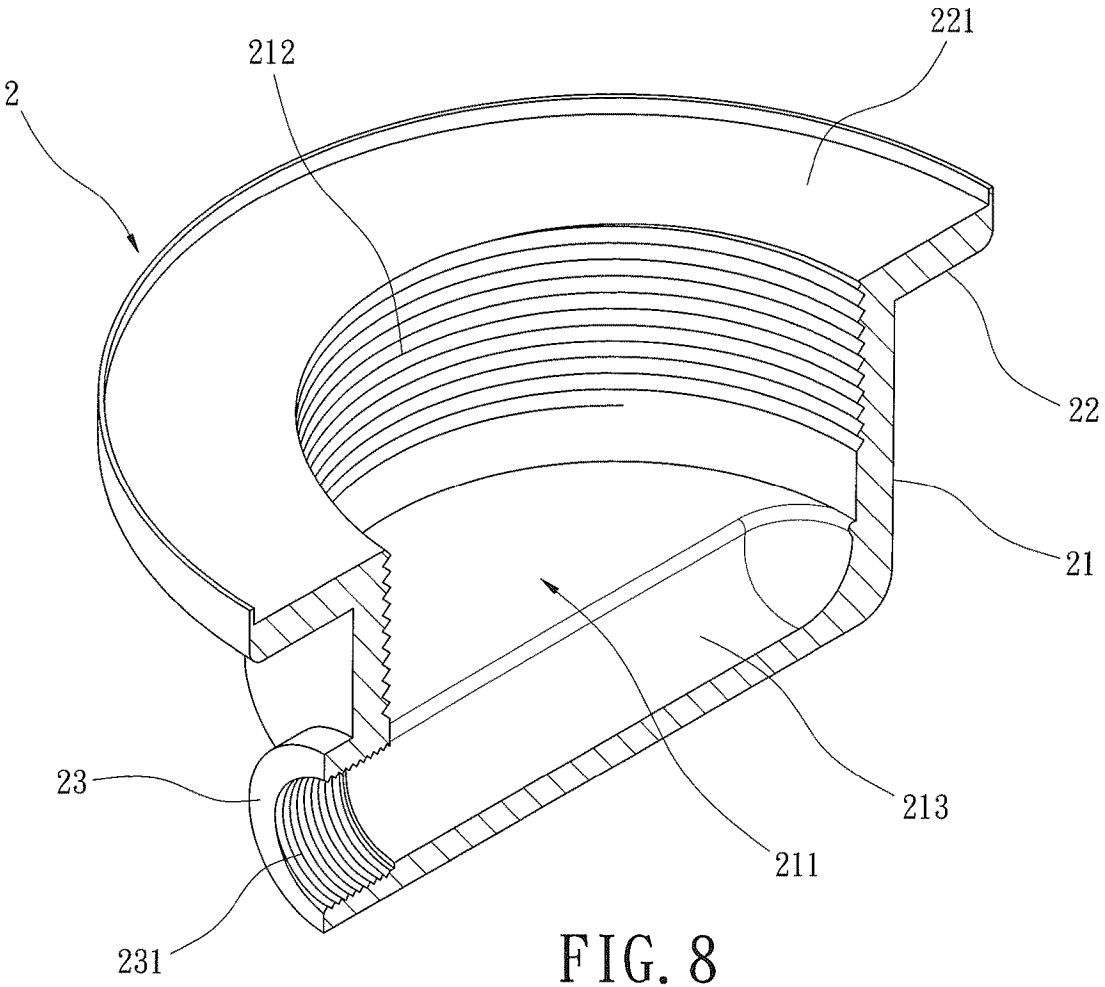
FIG. 8 is a partly cut-away perspective view of the water discharge box.
Figure 9:
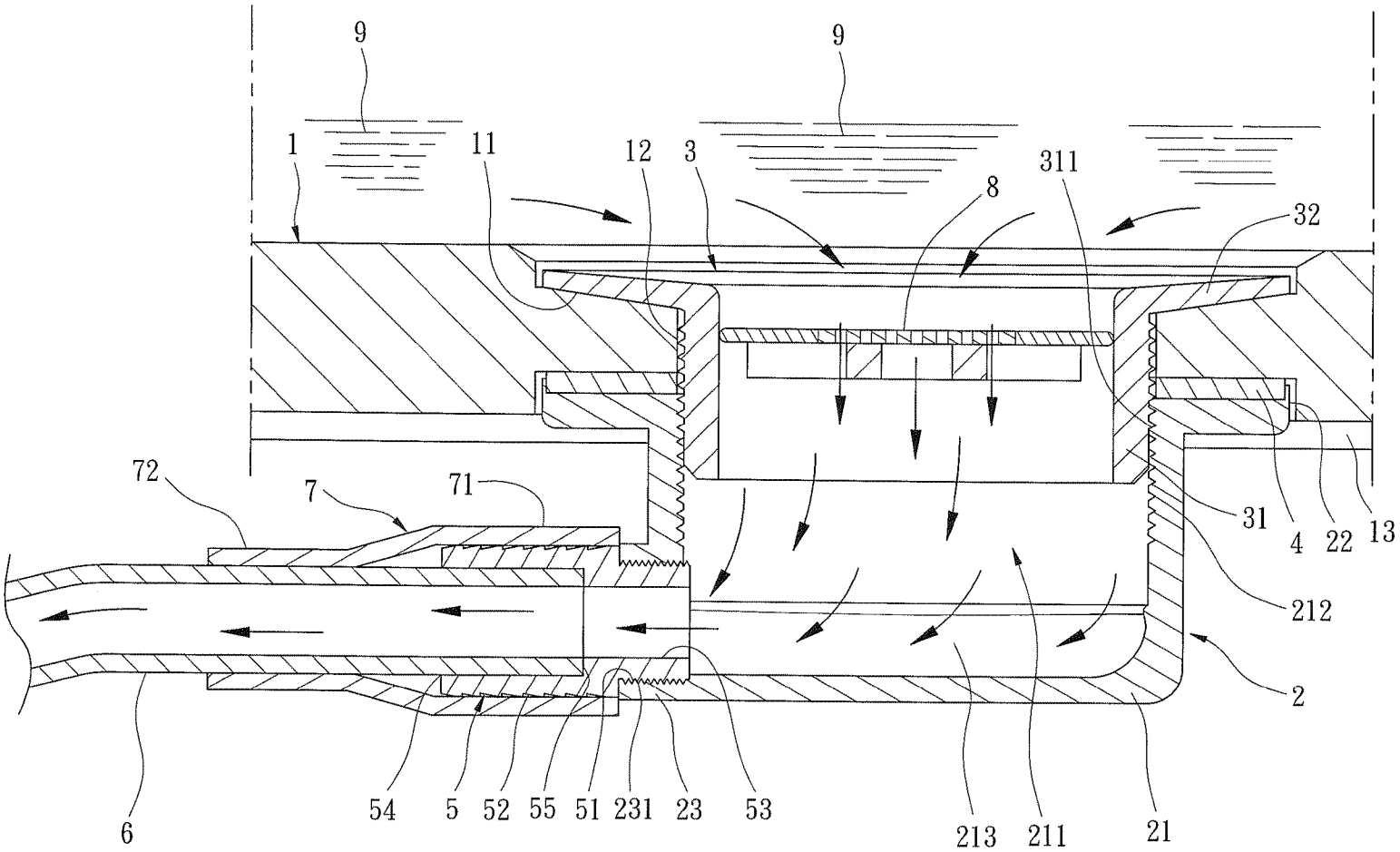
FIG. 9 is a cross sectional view illustrating discharge of water by the tea tray assembly.

With reference to FIGS. 8 and 9, in use of the tea tray assembly, waste tea/water 9 on the disc 1 passes through and is filtered by the filtration plate 8. Then, the waste tea/water 9 flows downward through the connecting portion 31 of the tightening member 3 into the water discharge box 2. Due to provision of the guiding channel 213 in the water discharge box 2 and the first passage 53 having an inner diameter not smaller than the inner diameter of the drainage tube 6, the waste tea/water 9 from the water discharge box 2 can rapidly fill the guiding channel 213, the first passage 53, and the drainage tube 6, reducing the water flow resistance, avoiding accumulation of water in the tea tray assembly resulting from slow discharge of water in the tea tray assembly. Thus, blockage at the water outlet 23 of the tea tray assembly can be avoided to save manual cleaning and dredging while permitting rapid assembly and disassembly, fulfilling practical needs.

Although specific embodiments have been illustrated and described, numerous modifications and variations are still possible without departing from the scope of the invention. The scope of the invention is limited by the accompanying claims.

The invention claimed is:

1. A tea water assembly comprising:

a disc including a top face and a bottom face opposite to the top face, with a positioning groove defined in the top face and having a bottom wall located between the top face and the bottom face of the disc, with a positioning hole extending from the bottom wall of the positioning groove through the bottom face of the disc;

a water discharge box mounted to the bottom face of the disc, with the water discharge box including a body having a water discharge chamber with an upwardly facing opening, with the water discharge chamber delimited by an inner peripheral wall having an inner thread, with the body further including an abutment portion extending transversely from an upper edge thereof, and with the abutment portion having a surface abutting the bottom face of the disc;

a tightening member including a connecting portion, with the connecting portion being hollow and having an outer thread, with the connecting portion further including a pressing and holding portion, with the connecting portion extending through the positioning hole of the disc, with the pressing and holding portion located in the positioning groove of the disc, with the outer thread of the connecting portion securely engaged with the inner thread of the water discharge box, retaining the pressing and holding portion to the bottom wall of the positioning groove.

2. The tea tray assembly as claimed in claim 1, with a limiting space defined in a face of the abutment portion of the water discharge box, with a gasket mounted in the limiting space, and with the gasket securely sandwiched between the abutment portion and the bottom face of the disc.

3. The tea tray assembly as claimed in claim 1, with the body of the water discharge box including a side having a water outlet, and with the water discharge chamber of the body including a bottom wall having a guiding channel intercommunicated with the water outlet.

4. The tea tray assembly as claimed in claim 1, further comprising a filtration plate mounted in the connecting portion of the tightening member.

5. The tea tray assembly as claimed in claim 1, further comprising a base mounted below the disc, with the base including a receiving space therein and an upper face, with a positioning rib formed on the bottom face of the disc and being annular, with the bottom face of the disc abutting the upper face of the base, and with the positioning rib positioned at an inner periphery delimiting the receiving space.

6. The tea tray assembly as claimed in claim 1, with the body of the water discharge box including a side having a water outlet, with a connecting tube and a drainage tube coupled to the water outlet, with the connecting tube including a first end having a first passage defined therein and a second end having a second passage defined therein and intercommunicated with the first passage, with the second passage having an inner diameter larger than an inner diameter of the first passage, with the first passage intercommunicated with the water discharge chamber, with an end of the drainage tube inserted into the second passage of the connecting tube, and with the inner diameter of the first passage not smaller than an inner diameter of the drainage tube.

7. The tea tray assembly as claimed in claim 6, with the water outlet of the water discharge box having an inner thread, and with the connecting tube having an outer thread in threading connection with the inner thread of the water outlet.

8. The tea tray assembly as claimed in claim 6, with the connecting tube including a stop face formed at an intersection between the second passage and the first passage, and with an end of the drainage tube abutting and positioned at the stop face.

9. The tea tray assembly as claimed in claim 6, further comprising a tightening sleeve mounted to an outer periphery of the connecting tube and an outer periphery of the drainage tube, with the tightening sleeve including a first tightening portion on an end thereof and a second tightening portion on another end thereof, with the connecting tube including an outer periphery having a tight-fitting conical face, with the first tightening portion mounted around the tight-fitting conical face, and with the second tightening portion mounted around the drainage tube.

* * * * *